United States Patent [19]

Wierzbicki et al.

[11] Patent Number: 4,695,930

[45] Date of Patent: Sep. 22, 1987

[54] INFRARED FLOODLIGHT ASSEMBLY

[75] Inventors: Julian J. Wierzbicki, Peabody; Kirti B. Chakrabarti, Danvers, both of Mass.

[73] Assignee: GTE Products Corporation, Danvers, Mass.

[21] Appl. No.: 783,710

[22] Filed: Oct. 3, 1985

[51] Int. Cl.[4] ..... F21V 9/00

[52] U.S. Cl. ..... 362/293; 362/294; 362/307; 362/310

[58] Field of Search ..... 362/293, 294, 307, 310, 362/311, 375

[56] References Cited

U.S. PATENT DOCUMENTS

| | | | |
|---|---|---|---|
| 3,701,895 | 10/1972 | Sweetser . | |
| 3,784,808 | 1/1974 | Mori . | |
| 3,883,732 | 5/1975 | Peterson et al. . | |
| 4,037,096 | 7/1977 | Brendgord et al. | 362/298 |
| 4,399,497 | 8/1983 | Druffel | 362/362 |
| 4,509,106 | 4/1985 | Mayer et al. | 362/307 |
| 4,604,680 | 8/1986 | Levin et al. | 362/293 |

*Primary Examiner*—Carroll B. Dority, Jr.
*Attorney, Agent, or Firm*—Lawrence R. Fraley

[57] ABSTRACT

An infrared floodlight assembly (10) including a cast aluminum outer housing (11) defining a central chamber (15) therein. A floodlight (14), having a tungsten halogen lamp as the light source, is spacedly positioned within a heat conducting member (43) within chamber (15) such that the floodlight is securedly positioned in an aligned manner relative to the assembly's filter (35) and lens (12) components. The invention also includes venting means (51) to allow air passage between the interior of the member (43) and the adjacent chamber (15), as well as engagement means (85) for engaging a rear surface of the floodlight (14) to retain it firmly against an internal flange of the member (43). A reflector (61), capable of being compressed to allow insertion or removal, is located within the heat conducting member's interior between the floodlight (14) and filter (35) to reflect infrared radiation toward the filter (35) and spaced lens (12).

14 Claims, 3 Drawing Figures

INFRARED FLOODLIGHT ASSEMBLY

The Government has rights in this invention pursuant to Contract No. 96-3736, awarded by the U.S. Department of Energy.

TECHNICAL FIELD

This invention is in the field of floodlight assemblies and, more particularly, relates to such assemblies which are infrared radiating.

CROSS REFERENCE TO COPENDING APPLICATIONS

In Ser. No. 727,961, now U.S. Pat. No. 4,604,680, filed Apr. 25, 1985 and entitled "INFRARED FLOODLIGHT" (inventors: George J. English and Robert E. Levin), there is defined an infrared floodlight and assembly utilizing same wherein the floodlight includes a light source (e.g., tungsten halogen lamp) which is disposed substantially between opposed, dichroic hot and cold mirrors. By a hot mirror is meant a component which reflects infrared ("hot") while transmitting visible ("cold") radiation. Alternatively, a cold mirror reflects visible and transmits infrared. The floodlight as defined in Ser. No. 727,961 may be utilized in the instant invention. Ser. No. 727,961 is now U.S. Pat. No. 4,604,680, having issued Aug. 5, 1986.

In an application filed concurrently herewith under Ser. No. 783,711 having a filing date of Oct. 3, 1985 and entitled "LUMINAIRE" (inventor: Julian J. Wierzbicki), there is defined an ornamental design for a luminaire.

BACKGROUND

Infrared floodlighting has significant application to security systems where it is often desirable to illuminate areas with infrared radiation not visible to the unaided human eye. Floodlighting of this type is particularly advantageous when used with closed circuit television surveillance equipment, but can also be used with direct passive viewing devices. Conventional infrared floodlight assemblies of the lens or reflector type typically utilize visible light-absorbing and infrared-transmitting filters located a short distance in front of the floodlight's lens to filter out visible light and pass infrared radiation therethrough. Since appreciable heat is absorbed by such filters, these known floodlight assemblies generally have been relatively large for the wattages involved in order to minimize the power density at the filters. At times, forced cooling has been required. With very few exceptions, cost has limited the filters to the form of flat plates, which in turn has increased the difficulty of producing desired wide beam spreads due to the increased absorption of rays which do not impinge normal to the filter. Consequently, not only is the visible radiation absorbed by such filters but certain infrared bands within the infrared spectrum are absorbed as well.

As mentioned above, the floodlight assembly described in the commonly-assigned. U.S. Pat. No. 4,604,680 employs a floodlight therein which in turn utilizes hot and cold dichroic mirrors as part thereof. Because such a floodlight, or practically any infrared-producing source for that matter, operates at high temperatures and thus generates relatively large quantities of heat, such heat must also be effectively dissipated if the overall structure is to perform satisfactorily.

Accordingly, a need exists for an infrared floodlight assembly capable of providing positive, aligned retention of the floodlight therein in such a manner that effective heat removal from both the lamp and any additional components (e.g., filter) if utilized, can occur, thereby assuring satisfactory operation of the overall assembly. Such a floodlight assembly would clearly represent a significant advancement in the art.

DISCLOSURE OF THE INVENTION

It is, therefore, a primary object of the instant invention to enhance the art of infrared floodlighting.

It is another object of this invention to provide an infrared floodlight assembly capable of assuring both positive alignment of the infrared source (floodlight) therein as well as effective removal of heat therefrom.

It is another object of this invention to provide a floodlight assembly which can be manufactured on a mass production basis and at reasonable costs.

In accordance with one aspect of the present invention, there is defined an infrared floodlight assembly which comprises a heat conductive housing including a forward opening and defining a chamber therein, a lens member secured to the housing and providing a cover for the forward opening, an infrared floodlight positioned within the chamber of the heat conductive housing for providing infrared radiation upon activation thereof, and retention means located within the chamber of the heat conductive housing and including a heat conducting member for securedly retaining the floodlight therein in a spaced relationship from the internal walls of the housing and in an aligned manner relative to the lens member such that infrared radiation from the floodlight will be directed substantially toward the lens member, the heat conducting member having an open end located adjacent the forward opening of the housing and defining a cavity therein, the floodlight being located within the cavity such that infrared radiation therefrom will pass through the open end.

In addition, an absorbing filter which absorbs visible radiation may be disposed within the heat conducting member's open end and thus between the floodlight and lens to absorb any remaining traces of visible wavelengths, while still passing desired infrared radiation therethrough. Further, the lens may be provided with an internal beam spreading surface to provide a desired degree of beam spread for the assembly. Still further, venting means may be utilized to allow air passage between the heat conducting member of the retainer and the housing's chamber to maintain the temperature gradient between opposed (inner, outer) surfaces of such an absorbing filter at an acceptable level. Lastly, engagement means may be utilized to engage the floodlight to assist in retaining it within the retainer in a fixed manner so as to assure positive alignment thereof relative to the adjacent lens.

BEST MODE FOR CARRYING OUT THE INVENTION

Figure 1:
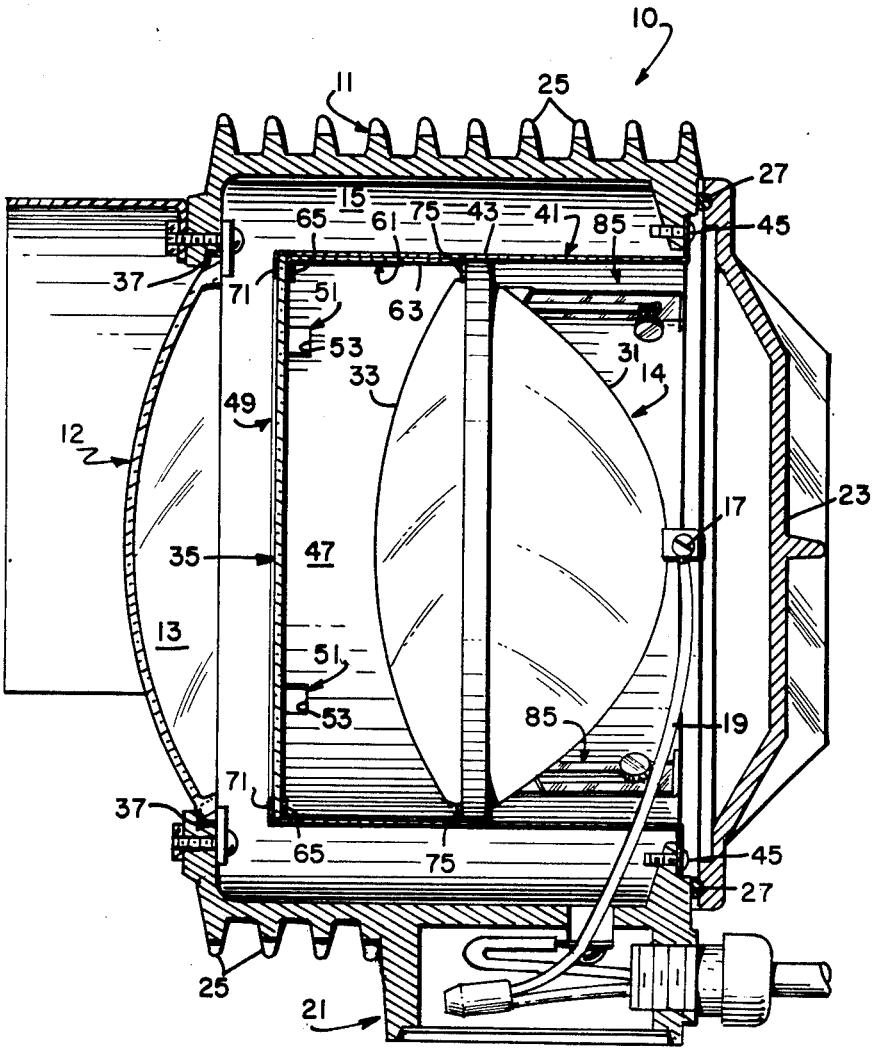
FIG. 1 is a side elevational view, partly in section, of an infrared floodlight assembly in accordance with a preferred embodiment of the invention.

With particular attention to FIG. 1, there is illustrated a floodlight assembly 10 in accordance with a preferred embodiment of the invention. Floodlight assembly 10 is designed for providing infrared radiation to a designated area (e.g., for purposes of surveillance).

Floodlight assembly 10 includes a heat conductive housing 11, a lens member 12 secured to and providing a cover for a forward opening 13 of housing 11, and a floodlight 14 which is positioned within and surrounded by housing 11 (and lens 12). The side and back walls of housing 11 serve to define a chamber 15 therein, floodlight 14 being so oriented within the housing so as to be substantially centrally disposed therein and spaced from the internal surfaces of the housing's walls.

The preferred floodlight for use in the invention is the floodlight described in the aforementioned U.S. Pat. No. 4,604,680, the disclosure of which is thus incorporated herein by reference. As described in U.S. Pat. No. 4,604,680, floodlight 14 includes an internally located light source (not shown) which, in a preferred embodiment, comprises a compact, double ended tungsten halogen lamp. This lamp includes a quartz glass tube envelope in which a coiled coil tungsten filament is centrally disposed between two opposed, terminal ends. A pair of conductive input lead wires extend from respective ends of the lamp through the rear of floodlight 14. These leads (not shown) are in turn each coupled to a respective electrical contact 17 (only one shown). Electrical wiring 19 is connected to these contacts and passes externally of housing 11 to a wiring box 21 located at the bottom of the housing. Accordingly, it is understood that at least two wires 19 are utilized, one for each contact. Connections are made at this location to connect wiring 19 to external wiring associated with a suitable power source (e.g., 120 VAC) sufficient to operate floodlight 14.

As stated, the preferred radiation source in floodlight 14 is a tungsten halogen lamp. In such lamps, a gas containing a halogen, such as bromine, iodine, chlorine or fluorine, is sealed within the quartz envelope of the lamp to provide a halogen regenerative cycle which enables tungsten particles evaporated from the hot filament to combine with the halogen to in turn form a halogen compound which enables the tungsten to be redeposited on the filament. Heat from the filament frees the halogen vapor which circulates to continue the regenerative cycle. This enables the quartz envelope to remain clean and free of tungsten particles, leading to the vastly longer life provided by tungsten halogen lamps. Tungsten halogen lamps are known in the art, with several types presently manufactured and sold by the assignee of this invention. It is preferred that the lamp's filament operate at the highest practical temperature. In this regard, it should be noted that the incandescent filament spectral power distribution is similar to that of a gray body. As the temperature is increased, the radiation peak shifts from the mid infrared range to approximately the 800 to 1000 nanometer region. Understandably, the maximum temperature is limited by the lamp life since these are inverse functions. A long life is, of course, desired. In one example, the filament operated at a temperature of about 2950 degrees Kelvin, and the lamp possessed a corresponding lamp life of about 4000 hours. The spectral energy distribution of the internally contained lamp is similar to that of standard incandescent lamps with only a small percentage (e.g., ten to twelve percent) of the total energy being in the visible spectrum. Approximately seventy percent of the energy is in the infrared spectrum and about 0.2 percent is in the ultraviolet spectrum. Floodlight 14, containing this lamp therein, possessed a power rating of about 500 watts.

In the instant invention, infrared radiation emitted from floodlight 14 is directed toward and out lens 12, which functions also as a cover, as explained above, and visible radiation is directed back towards the rear wall 23 of housing 11, where it is absorbed by an absorbing material, such as black paint (not shown), coated on the internal surface thereof. Housing 11 is metallic (e.g., cast aluminum) and thus of a sound heat conducting material. To enhance heat removal from within chamber 15, housing 11 preferably includes several spaced fins 25 located about the main body portion of the housing. This body portion is in turn of cylindrical configuration. To facilitate explanation, the walls of this body portion are defined as side walls whereas wall 23, as stated above, serves as a back wall. As shown, back wall 23, also cylindrical in shape, is removable from the body portion to provide replacement of floodlight 14 through the rear of assembly 10, as well as any repairs, adjustments or other maintenance if needed. Wall (or back cover) 23 is sealed to the cylindrical body portion of housing 11 using a suitable gasket 27 which is located about the entire periphery of the body portion at this location. Gasket 27 is preferably of heat resistant silicene rubber.

Floodlight 14, as defined in U.S. Pat. No. 4,604,680 combines the use of a dichroic hot mirror and a dichroic cold mirror, each being substantially positioned on opposite sides of the floodlight's internal tungsten halogen lamp. As understood, the function of both mirrors is to direct infrared radiation forward and the non-desired, visible radiation rearward. These members thus act as interference filters with the described dichroic hot mirror functioning to reflect infrared radiation and transmit visible radiation while the dichroic cold mirror reflects visible and transmits infrared. By the term "transmits" as used herein is meant to allow to pass therethrough. With particular attention to FIG. 1, floodlight 14 includes such a dichroic hot mirror 31 with such a dichroic cold mirror 33 secured thereto or forming a part (i.e., extension) thereof. Mirror (reflector) 31, located to the rear of the internally contained lamp, is preferably of paraboloidal configuration, while front mirror 33, also curvilinear, functions to provide a closure for the floodlight. Mirror 31 preferably includes a glass substrate which has a multilayered dichroic coating on the interior thereof.

The aforedescribed tungsten halogen lamp is located within floodlight 14 such that its tungsten filament is centered on the focal point of paraboloidal rear mirror 31. Thus, light rays reflected by this mirror in a forward direction will be substantially collimated and comprised mainly of radiation in the infrared spectrum directed outwardly towards the spacedly oriented lens 12. Contrarily, light rays in the visible spectrum pass through mirror 31 and impinge on the light-absorbing coating of wall 23. Light radiation emitted from the tungsten halogen lamp in the direction of lens 12, whether by reflection from mirror 31 or directly from this lamp, must thus impinge directly on cold mirror 33. This mirror, also comprised of a hard glass substrate, such as Pyrex, and internally coated with a multilayered dichroic coating, is secured to (or forms part of) mirror 31. Preferably, mirror 33 is a separate member secured to mirror 31 by flame sealing or by using a suitable sealing cement.

It is understood from the foregoing that mirrors 31 and 33 combine to form a sealed lamp cavity. To protect the aforementioned, internal metallic leads of the tungsten halogen lamp from possible contamination, this cavity is evacuated of oxygen during assembly and nitrogen or some other inert gas introduced at about one-third atmosphere.

Floodlight assembly 10 also includes filter means 35 located therein. Filter 35, being substantially planar and located between floodlight 14 and lens 12, functions to absorb any miscellaneous visible radiation which may escape and is not absorbed by housing 11, while allowing infrared energy to pass therethrough. The principal function of absorption filter 35 is to provide visual security. Since it is possible to visually detect radiation above 780 nanometers at sufficiently high power levels, absorption filter 35 preferably has a 50 percent cut-on wavelength at 830 nanometers with approximately a two percent transmittance at 800 nonometers. For those instances where complete visual security is unessential, a filter with about a 50 percent cut-on at approximately 800 nonometers can be used with an increase of about 35 percent in the near-infrared intensity. The steady state temperature rise of filter 35 is approximately 275 degrees Celsius above ambient. In one embodiment, filter 35 was a temperature colored glass filter having a three millimeter thickness and, as such, possessed a reversible shift of the absorption edge toward longer wavelengths with a corresponding increase of temperature. This was on the order of about 0.2 nanometer per degree Celsius.

To further assure prevention of visible radiation escape, the interior of housing 11 is darkened (painted black) entirely to the location of intersection with lens 12. This has proven successful in absorbing substantially all of such stray and undesired illumination. Preferably, the interior surface of the housing also includes a nonsmooth surface by utilizing a plurality of ribs or other corrugations (not shown) to further enhance radiation trapping. Thus, an appreciable portion of the power emitted by the floodlight's internal lamp is absorbed by the housing. The housing's outer surface has also been substantially increased for heat dissipation by providing the aforedescribed fins 25 thereon.

Lens 12 preferably includes an internal lenticular surface (not shown) to provide the desired degree of beam spread for assembly 10. A silicone rubber gasket 37 is employed to seal the lens to housing 11.

Understandably, successful operation of the instant invention depends on satisfactory removal of the relatively large quantities of heat generated by floodlight 14 during operation thereof. Further, it is essential that the floodlight be securedly positioned within assembly 10 so as to be effectively retained in an aligned manner relative to the remaining components thereof. Accordingly, assembly 10 further includes retention means 41 in the form of a cylindrical, heat-conducting member 43 positioned within chamber 15 of outer housing 11. Retention means 41, as shown, securedly retains floodlight 14 therein so that the floodlight is spacedly located from the internal surfaces of the aforementioned side walls of housing 11. In addition, floodlight 14 is aligned by retention means 41 so that the aforedescribed infrared radiation is directed toward filter 35 and lens member 12 located therebeyond. Understandably, misalignment of the floodlight will adversely affect the resulting beam pattern produced by the invention and thus reduce efficiency thereof.

The cylindrical heat-conducting member 43, preferably of aluminum, is secured to a back or rear surface of housing 11 (e.g.. using screws 45) and projects within chamber 15 in the manner indicated. Heat conducting member 43 defines a cavity 47 therin with floodlight 14 being located within this cavity. Housing 43 further includes an open end 49 in which is positioned filter means 35. As shown, infrared radiation emitted by floodlight 14 is directed toward open end 49 to pass through filter 35. Accordingly, filter 35 provides a closure for the open end of housing 43. Due to this enclosed relationship, it is imperative that heat generated within cavity 47 be allowed to pass externally of housing 43 to the adjacent, larger chamber 15 of the invention's external, cast aluminum housing 11. To provide this, the invention further includes venting means 51 in the form of a plurality of apertures 53 located about the cylindrical heat-conducting member 43 in a predetermined, spaced-apart orientation. A total of four apertures 53, each equally spaced about the cylindrical member 43, was used in one embodiment of the invention. These apertures allowed air passage between cavity 47 and chamber 15 to enable sufficient heat escape to the external portions of the invention.

Of significant concern when utilizing the aforedescribed filter means 35 is the need to maintain the temperature gradient between the opposed internal and external planar surfaces of the filter below an established level. Should such a level be exceeded, cracking of the glass filter can occur as a result of thermal shock. When using the aforedescribed glass filter, a temperature gradient of about 35° Celsius was deemed acceptable. The venting arrangement as described herein satisfactorily maintained this temperature gradient below this level during operation.

Figure 3:
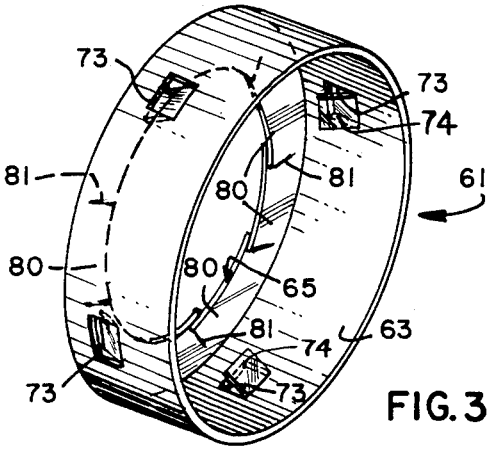
FIG. 3 is a reduced perspective view of a preferred embodiment of a reflector for use in the instant invention, with portions thereof being slightly exaggerated in comparison to FIG. 1 for illustration purposes.

To assure high efficiency for the invention, retention means 41 further includes therein reflector means 61 in the form of a substantially cylindrical, thin metallic (aluminum) member 63 which is located within cavity 47 between the floodlight 14 and open end 49 (and filter means 35). This cylindrical reflector, also illustrated in reduced size in FIG. 3. possesses an outer diameter substantially similar to the corresponding internal diameter of heat conducting member 43 such that the reflector will be snugly positioned therein. As shown in FIG. 3, reflector 61 further includes a continuous flange portion 65 which, as shown in FIG. 1, serves to positively engage and thus assist in retaining filter means 35 within open end 49. Flange portion 65 is shown in slightly exaggerated form in comparison to the preferred form depicted in FIG. 1 for illustration purposes. Specifically, flange portion 65 is shown slightly enlarged to better illustrate (and facilitate explanation of) the overlapping, slotted segments 80 thereof (see below). As shown, heat conducting member 43 includes a corresponding, continuous outer flange 71 for engaging (and retaining) the opposing external side of filter 35. To allow the aforementioned air passage from cavity 47 to outer chamber 15, cylindrical reflector 61 includes a plurality of orifices 73 which are similar in number to the aforedescribed apertures 53 and which align therewith when reflector 61 is snugly positioned within member 43. Orifices 73 are depicted in FIG. 3. As also shown, each orifice 73 includes an inwardly projecting tab 74 which functions to block undesired visible radiation from the floodlight from passing through the orifice. Thus, each tab opens in a direction toward filter 49.

One particular unique feature of infrared radiation reflector 61 is that it can be positioned within cylindrical heat conducting member 43 in a substantially facile manner. As shown in FIG. 1, member 43 further includes flange 75 of continuous nature about the interior thereof, this flange designed for positively engaging a projecting rim segment or the like of floodlight 14. To position reflector 61 within member 43, it is thus necessary to pass this component over this flange or, alternatively, over the outer flange 71. To accomplish this. the continuous flange portion 65 of reflector 61 is provided with a plurality of overlapping segments 80 which in turn are defined by a series of spaced end slots 81 which enable the reflector to be compressed slightly such that its overall external configuration is slightly less than the corresponding internal diameter of either of the flanges 71 or 75. Once positioned, the reflector is capable of expanding to its original, substantially cylindrical outer configuration as shown in FIG. 1 to then assume the defined snug positioning within member 43. Such compressibility also facilitates alignment of the apertures 53 and associated orifices 73.

Figure 2:
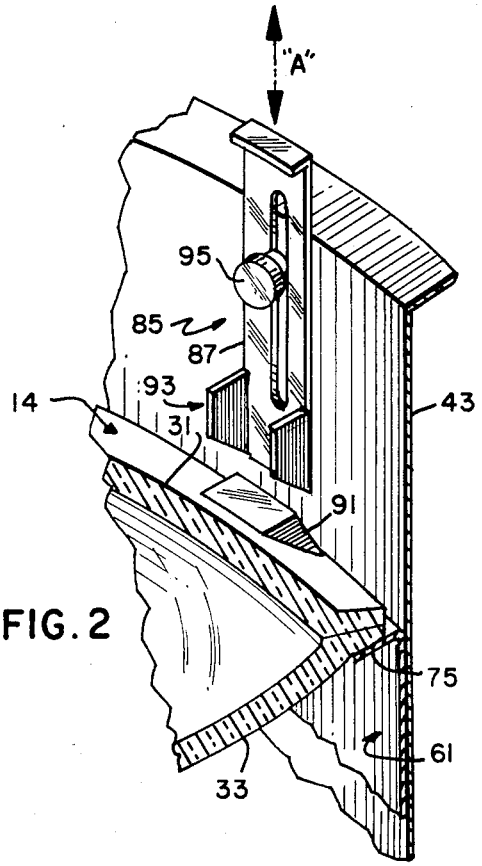
FIG. 2 is an enlarged, partial perspective view of one of the engagement members of the invention in accordance with a preferred embodiment thereof.

To assist in maintaining floodlight 14 in fixed alignment within member 43, assembly 10 further includes engagement means 85 (see also FIG. 2). Engagement means 85 comprises a plurality of individual bracket members 87 which are spacedly located about an internal surface of member 43. In one embodiment, three of these members 87 were utilized and oriented at predetermined spacings about member 43. More specifically, the three engagement members were positioned at angular intervals of 130°, 130°, and 100°, respectively. With particular attention to FIG. 2, each bracket member 87 is adjustably secured to heat conducting member 43 such that it is able to move inwardly and outwardly (direction "A") relative to floodlight 14. As shown in FIG. 2, an upstanding boss 91 is located on the rear, external surface of the floodlight relative to each bracket. Accordingly, each bracket includes a corresponding, flanged U-shaped segment 93 for aligning with and engaging the boss and external surface. Understandably, a total of three bosses 91 is utilized to accommodate a similar number of adjustable brackets 87. Adjustment to each of the brackets is accomplished using a thumbscrew 95 which is positioned within a threaded opening within the wall of member 43. Floodlight 14 is positioned within retainer member 43 by simply inserting the floodlight within the retainer's rear opening (that adjacent back wall 23 of housing 11) until the aforementioned rim portion engages flange 75. Thereafter, the adjustable brackets are pushed inwardly until engagement is accomplished with the rear surface of the floodlight about the respective bosses 91. Each thumbscrew is then tightened and the floodlight is securedly positioned.

To assure positive alignment of the floodlight in a predetermined manner (so that the lamp contained therein is oriented in an established manner), the bosses 91 are positioned in a staggered, angular relationship. Accordingly, the assembly operator need only align these bosses with the corresponding adjustable brackets 87.

There has thus been shown and described an infrared floodlight assembly wherein substantially all of the visible radiation produced by the assembly is internally absorbed through the utilization of hot and cold dichroic mirrors and suitable absorbing means such that substantially only infrared radiation is emitted. The invention is able to utilize a conventional light source (i.e., tungsten halogen lamp). By strategically positioning the various internal components as defined above, the invention substantially prevents excessive beam spread prior to filtering, to thereby enhance operation thereof. The assembly is thus also able to utilize an internal filter (visible-absorbing) that is not subjected to extreme amounts of visible radiation. Of particular significance, the invention as defined herein provides excellent heat flow away from the contained (enclosed) floodlight while still maintaining the floodlight in both a fixed and aligned orientation within the assembly. The invention is thus capable of withstanding shock and relatively high ambient temperatures (as well as changes thereof) without an adverse affect on the operation thereof.

While there have been shown and described what are at present considered the preferred embodiments of the invention, it will be obvious to those skilled in the art that various changes and modifications, in addition to those described, may be made therein without departing from the scope of the invention as defined by the appended claims. For example, it is possible to utilize a non-planar (e.g., curvilinear) visible-absorbing filter in place of the planar filter 35. To further reduce heat buildup on filter 35, it is also possibe to extend the distance between this component and the curvilinear cold mirror 33.

What is claimed is:

1. An infrared floodlight assembly comprising:

a heat conductive housing including a forward opening and defining a chamber therein;

a lens member secured to said housing and providing a cover for said forward opening;

an infrared floodlight positioned within said chamber of said heat conductive housing for providing infrared radiation upon activation thereof; and retention means located within said chamber of said heat conductive housing and including a heat conducting member for securedly retaining said floodlight therein in a spaced relationship from the internal walls of said housing and in an aligned manner relative to said lens member such that infrared radiation from said floodlight will be directed substantially toward said lens member, said heat conducting member having an open end located adjacent said forward opening of said housing and defining a cavity therein, said floodlight being located within said cavity such that infrared radiation therefrom will pass through said open end.

2. The assembly according to claim 1 further including filter mens for absorbing visible radiation from said infrared floodlight, said filter means positioned within said open end of said heat conducting member of said retention means and providing a closure therefor.

3. The assembly according to claim 2 wherein said filter means is comprised of glass and is of substantially planar configuration.

4. The assembly according to claim 2 further including venting means within said heat conducting member adjacent said filter means for allowing air passage between said cavity within said heat conducting member and said chamber located externally of said heat conducting member to maintain the temperature gradient between opposing surfaces of said filter means below a predetermined temperature during operation of said assembly.

5. The assembly according to claim 4 wherein said venting means comprises a plurality of apertures located within said heat conducting member in a predetermined, spaced apart orientation.

6. The assembly according to claim 5 further including reflector means located within said cavity of said heat conducting member between said floodlight and said open end of said heat conducting member for reflecting infrared radiation from said floodlight toward said filter means positioned within said open end.

7. The assembly according to claim 6 wherein said reflector means includes a flange portion for engaging said filter means to assist in retaining said filter means within said open end of said heat conducting member.

8. The assembly according to claim 6 wherein said reflector means includes a plurality of orifices located therein in a spaced-apart manner, each of said orifices aligning with a respective one of said apertures of said venting means to allow passage of said air therethrough.

9. The assembly according to claim 7 wherein said heat conducting member and said reflector means are each of a substantially similar configuation, said reflector means being located within said heat conducting member in a snug manner, said reflector means being compressible to facilitate positioning thereof within said heat conducting member.

10. The assembly according to claim 9 wherein said flange portion of said reflector means includes a plurality of overlapping segments therein to facilitate compression of said reflector means during said positioning within said heat conducting member.

11. The assembly according to claim 1 further including engagement means for positively engaging an external surface of said floodlight to securedly retain said floodlight within said cavity of said heat conducting member.

12. The assembly according to claim 11 wherein said engagement means comprises a plurality of spacedly oriented bracket members secured to said heat conducting member in an adjustable manner, each of said bracket members adapted for engaging said external surface of said floodlight at a predetermined location thereon.

13. The assembly according to claim 12 wherein each of said predetermined locations on said external surface of said floodlight includes at least one upstanding boss thereon, each of said bracket members aligning with and engaging a respective one of said bosses.

14. The assembly according to claim 1 further including reflector means located within said cavity of said heat conducting member between said floodlight and said open end of said heat conducting member for reflecting infrared radiation from said floodlight toward said open end.

* * * * *